US006047640A

United States Patent [19]

Murakawa

[11] Patent Number: 6,047,640

[45] Date of Patent: Apr. 11, 2000

[54] PRINTING MACHINE FOR CORRUGATED BOARD SHEETS AND METHOD OF CLEANING INK FOUNTAIN OF THE MACHINE

[75] Inventor: Ichiro Murakawa, Izumi, Japan

[73] Assignee: Umetani Mfg. Co., Ltd., Osaka, Japan

[21] Appl. No.: 09/298,100

[22] Filed: Apr. 22, 1999

[30] Foreign Application Priority Data

Apr. 23, 1998 [JP] Japan ..... 10-112903
Apr. 23, 1998 [JP] Japan ..... 10-112932

[51] Int. Cl.[7] ..... B41F 31/20; B41F 35/04

[52] U.S. Cl. ..... 101/350.5; 101/350.6; 101/423; 101/425

[58] Field of Search ..... 101/366, 425, 101/428, 350.1, 350.2, 350.5, 350.6, 351.1, 351.8, 352.13, 348, 349.1, 327–331, 363

[56] References Cited

U.S. PATENT DOCUMENTS

| | | | |
|---|---|---|---|
| 4,919,047 | 4/1990 | Inouye et al. | 101/177 |
| 5,265,535 | 11/1993 | Isowa et al. . | |
| 5,402,724 | 4/1995 | Yaeso et al. | 101/424 |
| 5,406,887 | 4/1995 | Hertel et al. | 101/366 |
| 5,425,809 | 6/1995 | Person | 118/264 |
| 5,440,982 | 8/1995 | Meadows et al. | 101/363 |
| 5,628,868 | 5/1997 | Marschke et al. | 156/578 |
| 5,915,302 | 6/1999 | Baba et al. | 101/366 |

FOREIGN PATENT DOCUMENTS

| | | |
|---|---|---|
| 0 338 403 | 10/1989 | European Pat. Off. . |
| 0 456 383 A1 | 11/1991 | European Pat. Off. . |
| 0 612 618 A2 | 8/1994 | European Pat. Off. . |
| 196 42 399 A1 | 4/1997 | Germany . |
| 03183549 | 8/1991 | Japan . |

*Primary Examiner*—Kimberly Asher
*Attorney, Agent, or Firm*—Arnold B. Silverman; Michael D. Lazzara; Eckert Seamans Cherin & Mellott, LLC

[57] ABSTRACT

An ink squeezing device for an anilox roll comprises a doctor blade adapted to contact the roll at an angle against the direction of rotation of the roll, and a bank member supporting the doctor blade along the anilox roll. An ink fountain is formed by the doctor blade, the anilox roll, the bank member and a pair of dam members. The ink squeezing device is coupled to a pressure cylinder device for pressing the doctor blade against the anilox roll. The cylinder device presses the doctor blade against the anilox roll during printing and during cleaning of the anilox roll. The doctor blade also serves the function of scraping off a cleaning liquid from anilox roll during cleaning of the roll.

4 Claims, 8 Drawing Sheets

PRINTING MACHINE FOR CORRUGATED BOARD SHEETS AND METHOD OF CLEANING INK FOUNTAIN OF THE MACHINE

FIELD OF THE INVENTION

The present invention relates to printing machines wherein ink is supplied from an ink fountain to a printing die mounted on a plate cylinder by means of an anilox roll which is rotatable in contact with the printing die, and to a method of cleaning the ink fountain of the machine.

BACKGROUND OF THE INVENTION

Printing machines for corrugated board sheets in use are divided into three types: printer-slotter machines for use with a highly viscous slow-drying glycolic ink, flexographic machines for use with a quick-drying aqueous ink of low viscosity, and printing machines previously proposed by the present applicant (JP-A No. 183549/1991) for use with a quick-drying glycolic ink which is nearly as low as the flexographic printing ink in viscosity. FIG. 9 is a side elevation schematically showing the printing machine proposed by the applicant. The machine has the advantages of both the printer-slotter press and the flexographic press.

The printing machine of FIG. 9 comprises an anilox roll 1 having minute indentations over the entire roll surface and movable into and out of contact with a printing die mounted on a plate cylinder 2, and an ink spray device 4*a* opposed to the anilox roll 1. A doctor blade 31 extending along the entire length of the roll 1 is in bearing contact with the roll 1 at an angle so as not to be opposed to the direction of rotation of the roll 1. A corrugated. board sheet 20 is nipped between and transported by the plate cylinder 2 and an impression cylinder 25 positioned under the plate cylinder 2.

The ink spray device 4*a* sprays the ink directly onto the anilox roll 1, and the ink dripping from the roll 1 is received by the doctor blade 31. The ink is sprayed onto the anilox roll 1 in a minimized quantity required to diminish the amount of ink remaining in the ink fountain 30 on the doctor blade 31 and to be discarded uselessly.

FIG. 10 is a side elevation showing a modification of the above machine. The modified machine has an ink squeezing rubber roll 3*a* opposed to the anilox roll 1 in contact therewith, and a doctor blade 3*b* bearing on the rubber roll 3*a*. The ink is supplied from an ink supply nozzle 42*a* positioned between the two rolls 1, 3*a* and held in an ink fountain 30 between the rolls 1, 3*a*. An excess of ink is squeezed from the surface of the anilox roll 1 by the ink squeezing action of the rubber roll 3*a*.

The printing machines shown in FIGS. 9 and 10 have no need to incessantly recycle the ink to prevent solidification of the ink unlike the flexographic press, therefore require no ink recycling device and can be simplified in construction. The machines further have the advantage that the ink dries fast because of its properties to produce a glossy print surface.

However, the machines described have the following problems. The ink for use in the printing machines of FIGS. 9 and 10, although low in viscosity, has a slightly higher viscosity than the flexographic ink, so that when the excessive ink is scraped off from the anilox roll 1, the ink partly remains unscraped. In other words, the ink adhering to the flat surface of the anilox roll 1 other than the indentations thereof needs to be scraped off by the doctor blade as intended, whereas the slightly higher viscosity is likely to permit a thin layer of ink to remain on the flat surface. Consequently, an excess of ink will be supplied to the printing die on the plate cylinder 2 to give a poor finish to the print. It is also likely that spots of ink as supplied will occur, failing to give a uniform finish to the print. Further when the anilox roll 1 is cleaned for a change of ink, the excessive amount of ink remaining on the roll 1 requires much time and labor for cleaning.

With the printing machine of FIG. 9, the doctor blade 31 provides the ink fountain 30 in cooperation with the anilox roll 1 and is accordingly disposed at an angle so as not to be opposed to the direction of rotation of the roll 1. The doctor blade therefore has a small force (squeezing force) to scrape the ink off the surface of the anilox roll 1. This also allows an excess of ink to be supplied to the printing die on the plate cylinder 2, producing local irregularities in the amount of ink supplied to the printing die.

The amount of ink to be sprayed is adjusted so as not to permit the ink to remain between the anilox roll 1 and the doctor blade 31 to the greatest possible extent. Nevertheless, an amount of ink becomes inevitably collected in the ink fountain 30, so that the change of ink involves the problem that cleaning uselessly washes away the residual ink with the cleaning liquid and requires a prolonged period of time.

In the case of the printing machine of FIG. 10, the rubber roll 3*a* pressed against the anilox roll 1 is elastically deformed. This results in a reduced ink scraping force, similarly permitting the ink to remain in the flat area of the anilox roll surface.

Further the rubber roll 3*a* which needs to be provided to the front of the anilox roll 1 gives an increased front-to-rear dimension to the printing machine.

Additionally, the doctor knife 3*b* bearing on the rubber roll 3*a* causes earlier damage to the roll 3*a*.

The ink fountain 30 of the printing machine shown in FIG. 10 also needs to be cleaned of the residual ink. The waste cleaning liquid then remains in the bottom of the ink fountain 30, entailing the drawback that the waste becomes mixed with the ink to be subsequently supplied to the fountain 30.

U.S. Pat. No. 5,265,535 discloses a printing machine for corrugated board sheets which has a doctor blade in contact with the surface of an anilox roll and oriented toward the direction of rotation thereof for controlling the amount of ink on the roll surface. For a change of ink, a scraping blade is brought into contact with the surface of the anilox roll to remove the residual ink, and the roll surface is cleaned by applying a cleaning liquid thereto. This machine is substantially of the same type as those of FIGS. 9 and 10 and has the foregoing problems.

SUMMARY OF THE INVENTION

An object of the present invention is to provide a printing machine free of the foregoing problems.

[Ink Squeezing Device]

An anilox roll 1 is provided with an ink squeezing device 3 which is movable into and out of contact with the roll 1. An ink feeder 4 and an ink collector 8 are arranged above the ink squeezing device 3. The squeezing device 3 has a bank member 32 supporting a doctor blade 31. The doctor blade 31 is made of a softer material than the anilox roll 1. The ink squeezing device 3 is coupled to a cylinder device 9 for pressing the doctor blade 31 against the anilox roll 1. For printing, the doctor blade 31 is driven by the cylinder device 9 into contact with the anilox roll 1 at an angle against the direction of rotation of the roll 1. The anilox roll 1, doctor blade 31, bank member 32 and a pair of dam members 35, 35 form an ink fountain 30.

When the anilox roll 1 is cleaned, the cylinder device 9 presses the doctor blade 31 against the anilox roll 1, permitting the doctor blade 31 to serve also the function of scraping off the ink and cleaning liquid remaining on the anilox roll 1 during the cleaning of the roll 1.

Further disposed above the anilox roll 1 is a nozzle 64 for supplying the cleaning liquid. The ink collector 8 has ink supplying-collecting nozzles 42, 42 and waste liquid collecting nozzles 54, 54 (FIG. 8) arranged beside the respective nozzles 42, 42 and each having a lower end positioned in the ink fountain 30 for collecting waste cleaning liquid by aspiration.

The doctor blade 31 bears on the anilox roll 1 against the rotation thereof and is pressed against the roll 1 by the cylinder device 9 during printing, so that whether the anilox roll 1 is rotated at a high or low speed, the ink can be scraped off from the flat surface of the roll 1 without leaving spots or irregularities. This obviates the likelihood that an excess of ink will be transferred from the anilox roll 1 to the plate cylinder 2, thereby promoting the production of beautiful prints. The doctor blade 31 is made of a softer material than the anilox roll 1 and therefore unlikely to cause damage to the roll 1.

[Cleaning Method]

When the ink squeezing device 3 and the anilox roll 1 are cleaned, the roll 1 is rotated with the doctor blade 31 of the device 3 bearing on the roll 1.

The cleaning liquid is applied directly or indirectly to the anilox roll 1, washes the surface of the roll 1 and is then scraped off by the doctor blade 31. The cleaning liquid flowing into the ink fountain 30 is collected by the waste liquid collecting nozzles 54, 54. Accordingly, the invention eliminates the conventional drawback that the waste cleaning liquid remaining in the ink fountain 30 becomes mixed with the ink to be subsequently supplied to the fountain 30.

DETAILED DESCRIPTION OF THE PREFERRED EMBODIMENTS

[First Embodiment]

Figure 1:
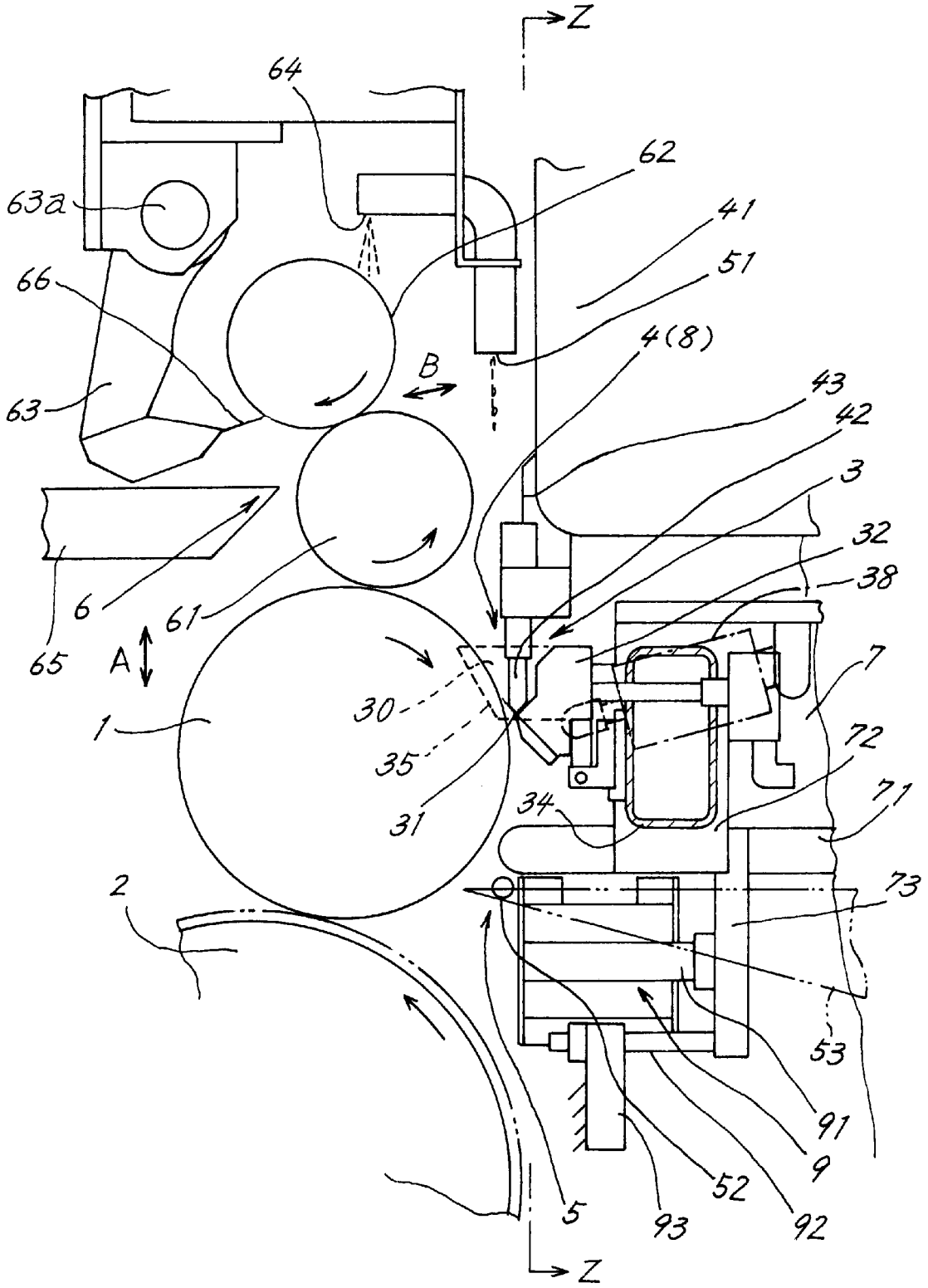
FIG. 1 is a side elevation showing the interior of a single-color printing machine.
Figure 5:
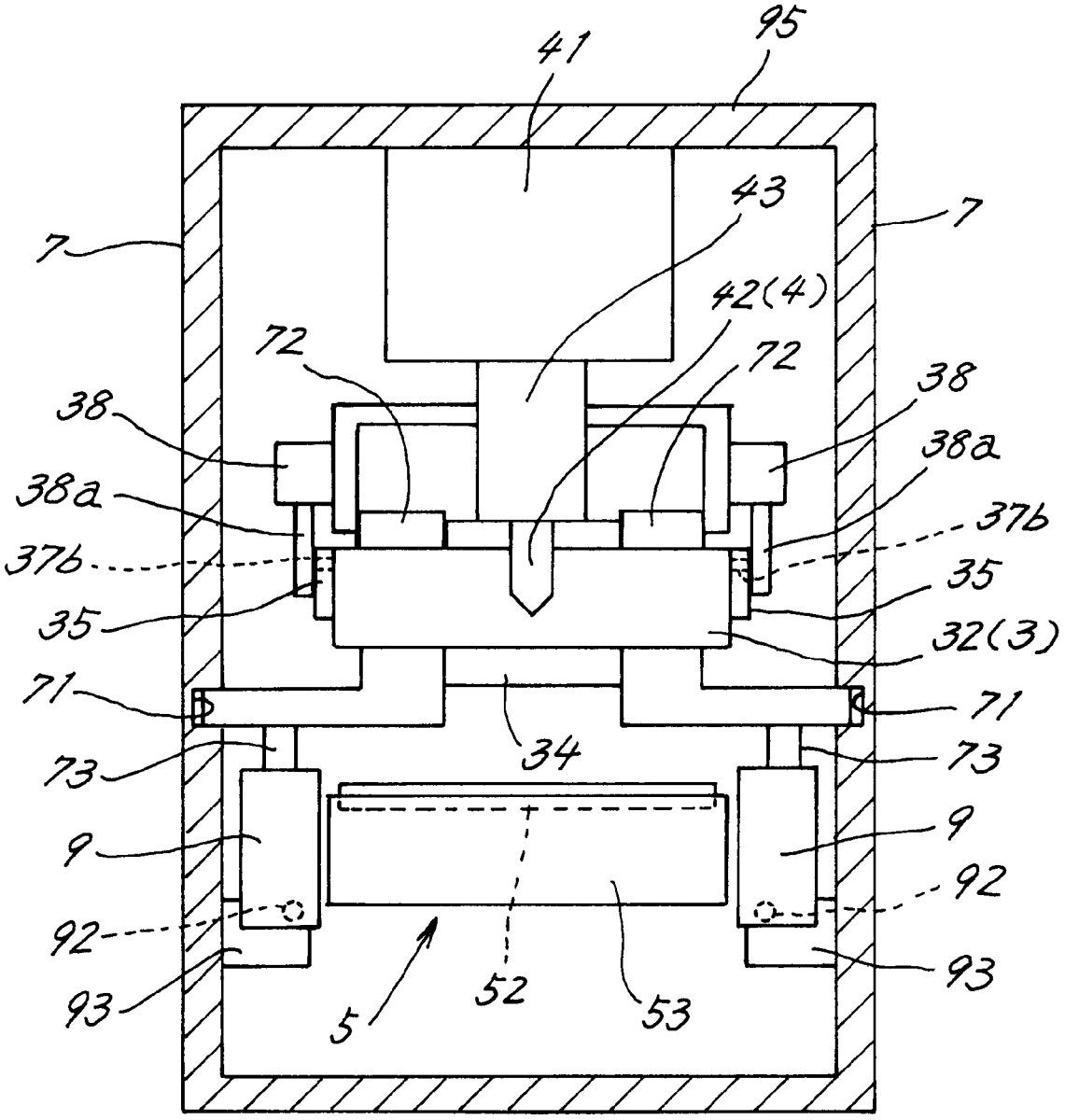
FIG. 5 is a front view of the machine as it is viewed in the direction of arrows Z in FIG. 1.
Figure 6:
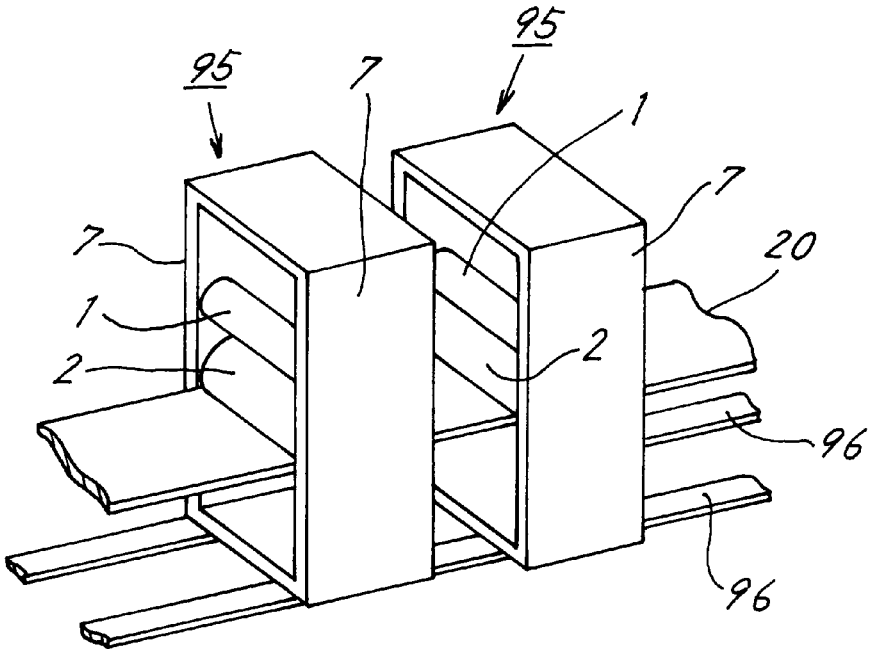
FIG. 6 is perspective view of a multicolor printing apparatus comprising a plurality of printing machines as arranged side by side.

FIG. 6 shows a multicolor printing apparatus comprising a plurality of single-color printing machines arranged on rails 96 along the direction of printing on a corrugated board sheet 20. Each printing machine has a frame 95 which is open at its front and rear sides, with plate cylinder 2, etc. arranged between a pair of left and right wall plates 7, 7. FIG. 1 is a side elevation showing the interior of the single-color printing machine, and FIG. 5 is a front view of the same as viewed in the direction of arrows Z. The plate cylinder 2 and an anilox roll 1 are not shown in FIG. 5. The printing machine is characterized in that a doctor blade 31 softer than the anilox roll 1 bears on the roll 1 against the rotation of the roll 1 to provide an ink fountain 30 with the doctor blade 31.

[Overall Construction]

The plate cylinder 2 in each printing machine rotates counterclockwise, and the corrugated board sheet passes beneath the cylinder 2 from the left-hand side of FIG. 1 toward the right, whereby a print is made. In the following description, the term "front" refers to the direction in which the corrugated board sheet advances from an upstream side downstream.

With reference to FIG. 1, the printing machine comprises the plate cylinder 2, the anilox roll 1 positioned above the plate cylinder 2 and movable into and out of contact with a printing die mounted on the cylinder 2 along an arrow A, an ink squeezing device 3 disposed in front of and opposed to the anilox roll 1, and an anilox roll cleaning device 6 disposed above the roll 1. The construction of the cleaning device 6 will be described later.

The anilox roll 1 rotates clockwise and has a surface which is provided by a hard material such as a ceramic as is already known and which is formed with minute indentations as arranged closely and regularly over the entire periphery thereof. The anilox roll 1 is movable into and out of contact with the printing die on the cylinder 2 by a known drive mechanism (not shown).

[Ink Squeezing Device]

Figure 3:
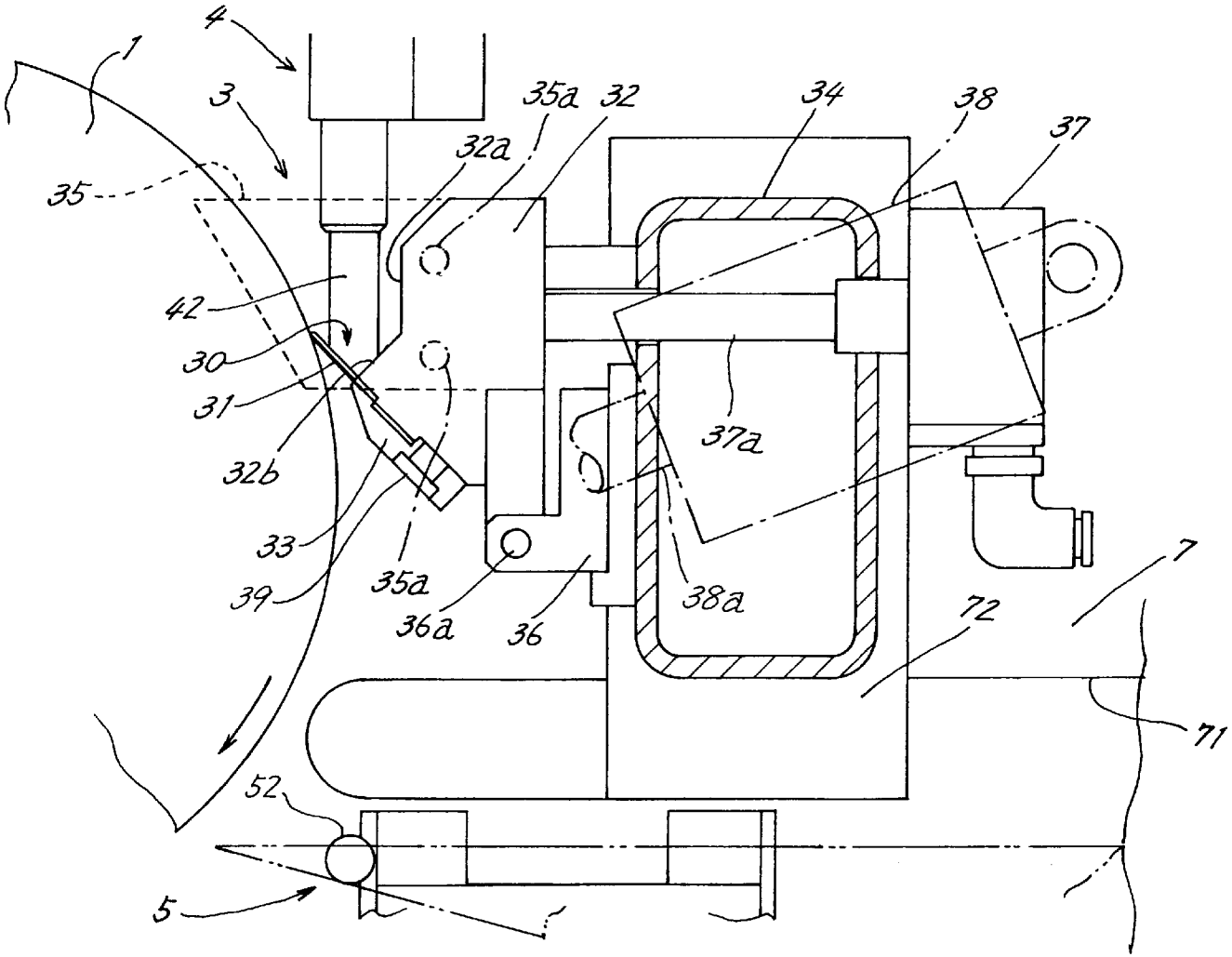
FIG. 3 is an enlarged side elevation of the ink squeezing device and an ink feeder-collector device.

Referring to FIGS. 3 and 5, each of the wall plates 7, 7 is formed in its inner surface with a guide groove 71 having fitted therein a slide block 72 which is movable forward and rearward. A stay 34 is held between the opposed slide blocks 72, 72.

As shown in FIG. 3, a bracket 36 is provided on the rear face of the stay 34, and a bank member 32 supported by a pivot 36*a* on the bracket 36 is turnable about the pivot through 90 degrees to face downward. The bank member 32 has supported thereon the doctor blade 31 opposed to the anilox roll 1 and made of a material softer than the anilox roll 1. The stay 34, doctor blade 31 and bank member 32 constitute the ink squeezing device 3.

The doctor blade 31 is fixed to the bank member 32 by fastening a pressing member 33 with a screw 39. The doctor blade 31 is replaceable with another one by loosening the screw 39.

The bank member 32 and the doctor blade 31 extending along the anilox roll 1 have a length approximately equal to the axial length of the roll 1. The doctor blade 31 is attached to the bank member 32 at an angle of 45 degrees with a vertical plane and is in contact with the peripheral surface of the roll 1 at a portion thereof slightly above the center of rotation of the roll 1.

Figure 4A:
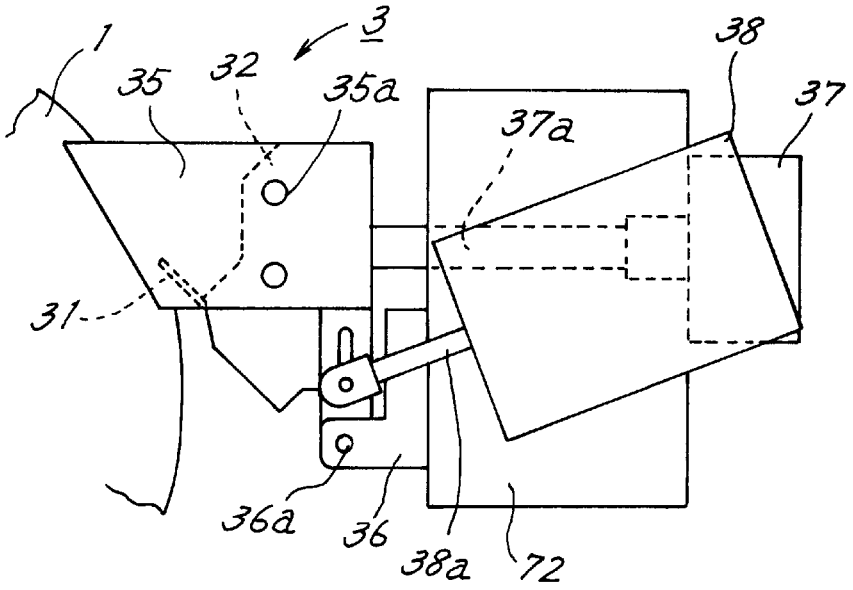
FIG. 4A is an enlarged side elevation of the ink squeezing device in a raised position.

The position of the doctor blade 31 in which the blade can be in contact with the anilox roll 1 as shown in FIG. 4A will be referred to as a raised position. The doctor blade 31 in the raised position bears on the roll 1 against the rotation thereof.

Figure 4B:
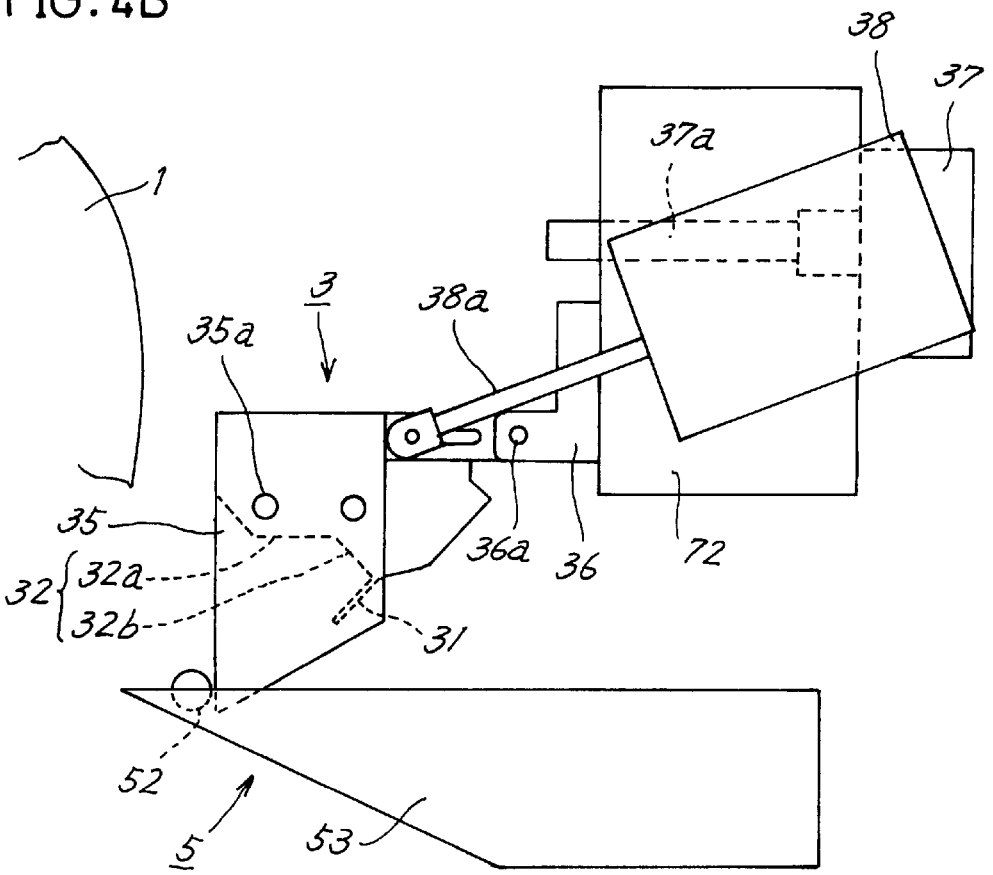
FIG. 4B is a similar view the device in a lowered position.

When the piston rods 38*a* of turning cylinder devices 38 are pushed out, with the doctor blade 31 moved away from the anilox roll 1 by advancing the ink squeezing device 3, the bank member 32 turns through 90 degrees to face downward as seen in FIG. 4B. This position will be referred to as a lowered position.

Platelike dam members 35, 35 covering the respective ends of the doctor blade 31 are fastened to the respective end faces of the bank member 32 with bolts 35*a*. Each dam member 35 is slidable in contact with the peripheral surface of end portion of the anilox roll 1 and the end face thereof.

The upper end of the dam member 35 shown in FIG. 3 is in coincidence with the upper end of the bank member 32. The anilox roll 1, bank member 32, doctor blade 31 and pair of dam members 35, 35 form the ink fountain 30.

The surface of the bank member 32 facing the anilox roll 1 includes an upper portion in the form of a vertical face 32*a* and a lower portion in the form of a slanting face 32*b* symmetric with the slope of the doctor blade 31. The vertical face 32*a* and the slanting face 32*b* of the bank member 32 and the inner surfaces of the dam members 35 and the doctor blade 31 are given high water repellency by surface treatment as by coating with a fluorocarbon resin.

Figure 2:
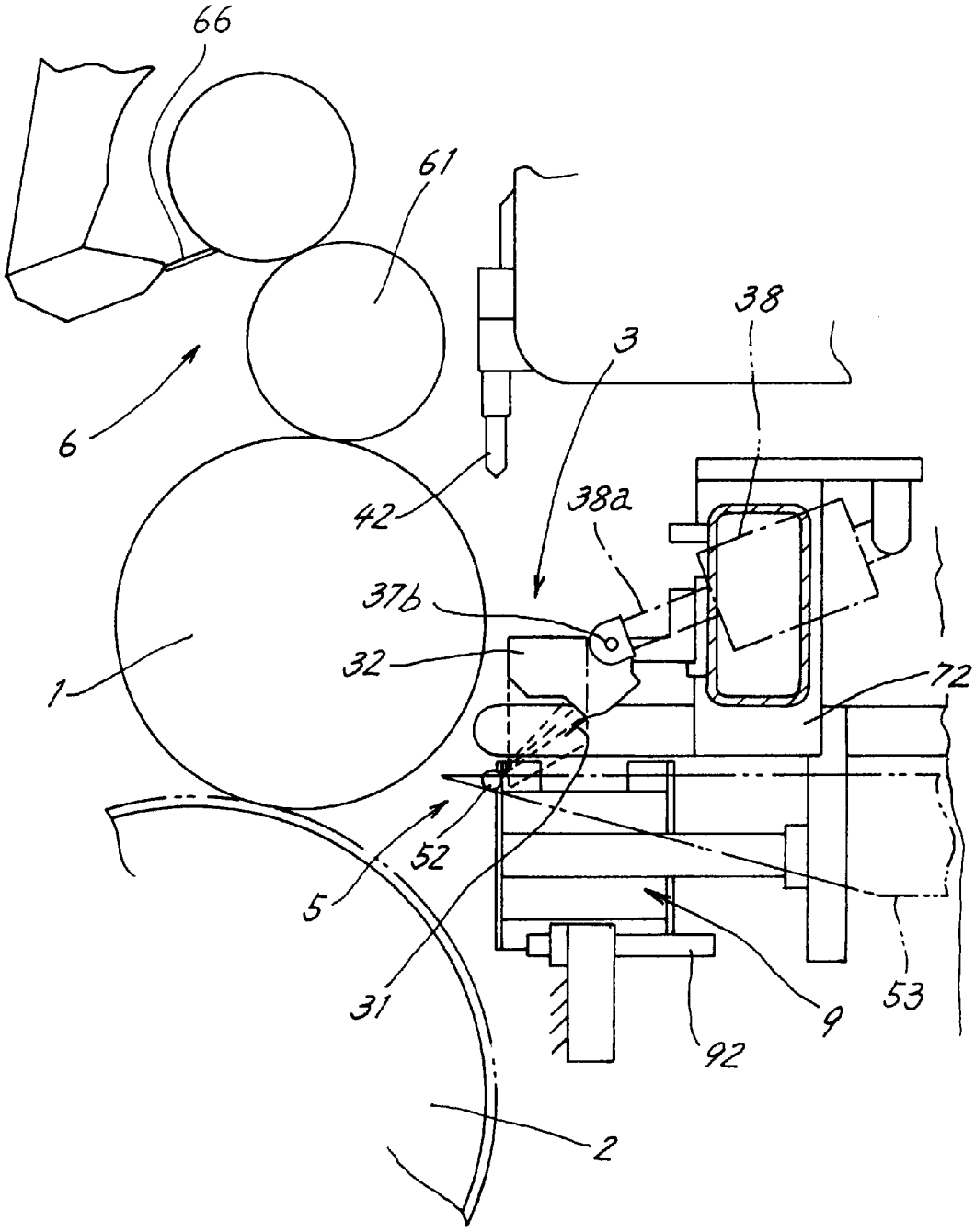
FIG. 2 is a side elevation showing the position relationship between ink supplying-collecting nozzles and an ink squeazing device as turned to face downward.

The turning cylinder devices 38, which are two in number, are coupled to the respective ends of the bank member 32. The cylinder devices 38 are mounted on the stay 34 and have their piston rods 38*a* pivoted as at 37*b* to the bank member 32 as seen in FIGS. 2, 4A and 4B.

With reference to FIG. 1, each slide block 72 is coupled to a pressure cylinder device 9 having a piston rod 91. The cylinder device 9 is positioned below the bank member 32 and fixed to the wall plate 7. The piston rod 91 is coupled to a connecting plate 73 extending downward from the slide block 72.

Disposed below the pressure cylinder device 9 is a stopper 92 for restricting the retracted position of the ink squeezing device 3 by contact with the connecting plate 73.

The stopper 92 is in the form of a threaded rod and screwed in a support block 93 fixed to the wall plate 7 to finely adjust the retracted position of the ink squeezing device 3.

The pressure cylinder devices 9 move the ink squeezing device 3 in the raised position toward the anilox roll 1, bringing the connecting plates 73 into contact with the respective stoppers 92, whereupon the doctor blade 31 comes into contact with the anilox roll 1.

When the squeezing device 3 needs to be in contact with the anilox roll 1, i.e., when ink is supplied to the ink fountain 30, the pressure cylinder devices 9 press the squeezing device 3 against the roll 1 during printing and while the anilox roll 1 is cleaned.

With reference to FIG. 3, blade pressure adjusting cylinder devices 37 are provided on the front side of the stay 34 and each have a piston rod 37*a* slidably extending through the stay 34 rearward and bearing on the front surface of the bank member 32. In actuality a plurality of pressure adjusting cylinder devices 37 are provided as approximately equidistantly spaced apart axially of the anilox roll 1.

The blade pressure adjusting cylinder devices 37 adjust the pressure of the ink squeezing device 3 on the anilox roll 1 with a controlled pneumatic pressure. The doctor blade 31 is brought into contact with the roll 1 by the pressure cylinders 9 as previously stated, and the pressure of the blade 31 is optimally adjusted by the pressure adjusting cylinder devices 37. Stated more specifically, the doctor blade 31 is roughly positioned in place by the pressure cylinder devices 9, and the pressure of the blade 31 on the anilox roll 1 is adjusted by the pressure adjusting cylinder devices 37.

[Ink Feeder]

With reference to FIGS. 1 and 5, an ink feeder 4 is disposed above the ink squeezing device 3. Although FIGS. 1 and 5 show only one ink feeder, a plurality of feeders may be arranged along the anilox roll 1. The feeder 4 is movable axially of the roll 1.

According to the present embodiment, the ink feeder 4 serves also as an ink collector 8. The ink feeder 4 has a vacuum-pressure box 41 disposed above the ink fountain 30, an ink tank housed in the box and a tube 43 extending from the ink tank to the outside of the box 41. The tube 43 is connected to a plurality of ink supplying-collecting nozzles 42 each in the form of a round pipe and arranged above the ink fountain 30 upwardly and downwardly movably.

The drive means (not shown) for moving the nozzles 42 upward and downward may comprise a cylinder device, a rack and a pinion in combination, or any other device.

When compressed air is supplied to the vacuum-pressure box 41 for pressurization, ink is supplied from the nozzles 42. The ink remaining in the ink fountain 30 is collected into the ink tank within the box 41 by aspiration when the box 41 is given a negative pressure, with the nozzles 42 lowered to position their lower ends in the fountain 30.

The lower end of each ink supplying-collecting nozzle 42 has its front and rear sides cut at an angle of 45 degrees. When lowered, the lower end comes into contact with the V-shaped bottom portion of the fountain having an angle of 90 degrees made by the doctor blade 31 and the slanting face 32*b* of the bank member 32 (see FIG. 3).

[Cleaning Device for Ink Squeezing Device]

Figure 7:
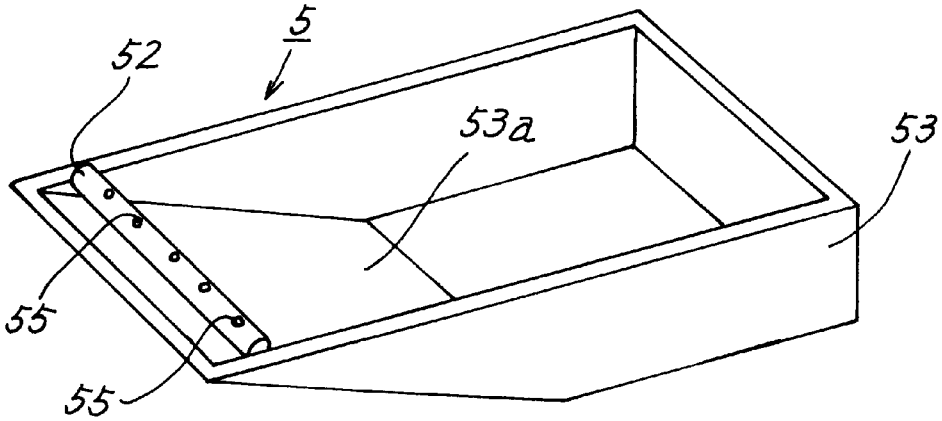
FIG. 7 is a perspective view of a cleaning device.

A cleaning device 5 is provided below the ink squeezing device 3. The cleaning device 5 has a pipe 52 for forcing out a cleaning liquid against the doctor blade 31 of the squeezing device 3 in its turned posture and the vertical face 32*a* and the slanting face 32*b* of the bank member 32 of the device 3. With reference to FIG. 7 which is a perspective view of the cleaning device 5, the pipe 52 is disposed in parallel to the anilox roll 1 at the rear end of a receptacle 53 and formed with orifices 55 for jetting out the cleaning liquid. The pipe 52 has one end connected to a device (not shown) for supplying the cleaning liquid. The receptacle 53 has a slope 53*a* for allowing the cleaning liquid to flow down.

[Anilox Roll Cleaning Device]

As shown in FIG. 1, a water supply nozzle 51 is disposed above the ink supplying-collecting nozzle 42 for placing water dropwise into the ink fountain 30 to adjust the viscosity of the ink.

The anilox roll cleaning device 6 comprises a rubber roll 61 positioned above the anilox roll 1, a scraping roll 62 positioned above the rubber roll 61, a doctor knife 66 movable into contact with the scraping roll 62 and a cleaning liquid supply nozzle 64 for forcing out the cleaning liquid onto the scraping roll 62.

While the scraping roll 62 is rotatably supported in a fixed position, the rubber roll 61 is so disposed as to be movable into contact with the anilox roll 1 as spaced apart from the plate cylinder 2 and with the scraping roll 62 from the front and to be movable away from these rolls 1, 62, along the respective arrows B in FIG. 1. Coupled to opposite ends of the rubber roll 61 are respective cylinder devices (not shown) for moving the rubber roll 61 forward or rearward. The rubber roll 61 is pressed into contact with the anilox roll 1, whereby soil is scraped off the roll 1 and transferred onto the scraping roll 62, from which the soil is scraped off by the doctor knife 66. The soil is collected in a receptacle 65.

The doctor knife 66 is attached to an arm 63 supported as at 63*a* pivotably in a plane orthogonal to the axis of the anilox roll 1, and is movable into contact with the peripheral surface of the scraping roll 62 at a position below and to the rear of the center of rotation of the roll 62. The doctor knife 66 can be moved away from the roll 62 by forcibly turning the arm 63 rearward. The receptacle 65 for receiving the waste cleaning liquid is disposed below the doctor knife 66.

[Details of Operation]

A description will be given below of the procedure for using the printing machine and the operation thereof.

Printing

The rubber roll 61 of the anilox roll cleaning device 6 is in an advanced stand-by position away from the anilox roll 1.

The ink squeezing device 3 is raised with the doctor blade 31 in bearing contact with the anilox roll 1. Ink is supplied to the ink fountain 30 through the supplying-collecting nozzles 42 while being so controlled that the liquid level will not exceed the upper ends of the dam members 35 and the bank member 32. This control can be realized by providing a liquid level detector (not shown) comprising a sensor, for example, at the upper end of the bank member 32.

The anilox roll 1 is brought into contact with a printing die mounted on the plate cylinder 2. The movement of the roll 1 toward the plate cylinder 2 will not permit the doctor blade 31 to leave the anilox roll 1 since the ink squeezing device 3 is urged toward the roll 1 by the cylinder devices 9.

The rotation of the anilox roll 1 permits the ink in the fountain 30 to adhere to the surface of the roll 1 and to move past the doctor blade 31, which in turn scrapes off an excess of ink.

The doctor blade 31 is in bearing contact with the anilox roll 1 against the rotation thereof, urged toward the roll 1 by the cylinder devices 37 and therefore capable of effectively scraping the ink off the flat surface of the roll 1 without allowing the ink to be excessively transferred from the roll 1 onto the printing die around the plate cylinder 2 to provide beautiful prints.

The doctor blade 31, which is prepared from a softer material than the anilox roll 1, will not damage the roll 1.

The pressure of the doctor blade 31 on the anilox roll 1 is adjustable by controlling the air pressure to be given to the blade pressure adjusting cylinder devices 37. Thus, the amount of ink on the anilox roll 1 can be adjusted optimally.

Ink Change

For a change of ink, the ink supplying-collecting nozzles 42 of the ink collector 8 are lowered, and the ink is collected from the fountain 30 into the ink tank within the vacuum-pressure box 41.

The ink is collected by aspiration under a negative pressure, while the lower ends of the nozzles 42 are shaped in conformity with the shape of the V-shaped bottom portion of the fountain 30 having an angle of 90 degrees, so that almost the entire quantity of ink in the fountain 30 can be collected.

Cleaning of Anilox Roll

The anilox roll 1 is moved away from the plate cylinder 2 with the doctor blade 31 held in contact therewith.

The rubber roll 61 is retracted into contact with the anilox roll 1 and the scraping roll 62.

The anilox roll 1 is drivingly rotated clockwise while forcing out a cleaning liquid from the supply nozzle 64 onto the scraping roll 62. The liquid flows from the scraping roll 62 onto the anilox roll 1 by way of the rubber roll 61, cleaning the surface of the anilox roll 1.

The cleaning liquid partly flows from the anilox roll 1 into the ink fountain 30. This portion of the liquid further washes the ink from the surface of the anilox roll 1 and is scraped off by the doctor blade 31.

As previously described, the ink in the fountain 30 has been collected therefrom by being aspirated by the ink collector 8 before cleaning, remaining in such a small amount as to wet the inner surface of the ink fountain 30. Accordingly, the ink squeezing device 3 and the anilox roll 1 can be completely cleaned within a short period of time by applying a small amount of cleaning liquid. The amount of ink washed away uselessly is therefore so small as to be negligible.

The rubber roll 61 is rotated counterclockwise by frictional contact with the anilox roll 1, while the scraping roll 62 is rotated clockwise by frictional contact with the rubber roll 61. The cleaning liquid wetting the surface of the anilox roll 1 is absorbed by the rubber roll 61, then transferred to the scraping roll 62, scraped off by the doctor knife 66 and collected in the receptacle.65.

The scraping roll 62 is cleaned with the cleaning liquid applied thereto by the supply nozzle 64. The surface of the roll 1 can be cleaned almost completely by several turns of rotation of the anilox roll 1.

No waste cleaning liquid will remain in the form of a line on the anilox roll 1 at the portion thereof in contact with the doctor blade 31 or the rubber roll 61 since the anilox roll 1 is held in rotation while being cleaned. After the completion of cleaning, the doctor knife 66 is moved away from the scraping roll 62, and the rubber roll 61 from the anilox roll 1 and the scraping roll 62.

Cleaning of Ink Squeezing Device

The cleaning liquid flows into the ink fountain 30 during the cleaning of the anilox roll 1 as already described. First, this cleaning liquid is removed. The ink supplying-collecting nozzles 42 are raised and thereby moved out of the path of forward or rearward movement of the ink squeezing device 3. The device 3 is advanced by the pressure cylinder devices 9 to move the doctor blade 31 away from the anilox roll 1, whereupon the waste cleaning liquid flows over the doctor blade 31 into the receptacle 53 therebelow. The squeezing device 3 is turned downward to the lowered position by the turning cylinder devices 38. The waste cleaning liquid remaining between the blade 31 and the bank member 32 is discharged into the receptacle 53.

Next, the cleaning liquid is forced out from the orifices 55 of the pipe 52 onto the inner surface of the doctor blade 31 and the bank member 32 of the ink squeezing device 3 as shown in FIG. 4B.

The inner surfaces of the bank member 32 and the dam members 35 are given high water repellency by surface treatment, therefore drain well and need not be wiped with a fabric. The waste cleaning liquid is received by the receptacle 53.

Resetting

The ink squeezing device 3 is raised by the turning cylinder devices 38 and brought toward the anilox roll 1 by the pressure cylinder devices 9. The blade pressure adjusting cylinder devices 37 exert pressure on the bank member 32, pressing the doctor blade 31 into contact with the anilox roll 1.

The ink is supplied to the ink fountain 30 from the ink feeder 4. The anilox roll 1 is brought into contact with the printing die mounted on the plate cylinder 2. The ink is transferred to a corrugated board sheet for printing.

Maintenance of Ink Squeezing Device

With the ink squeezing device 3 advanced by the pressure cylinder devices 9, maintenance can be performed easily on the required portion of the device through the open front side of the frame 95 (see FIG. 5).

In practicing the present invention, the ink feeder and the ink collector may be provided separately. Insofar as the ink collector is designed for collection by aspiration, the collector can be, for example, of the tubing pump type and is not limited in construction.

The waste cleaning liquid collected in the receptacles 53, 65 is led into a treatment tank, treated as required and then discharged into the sewerage system. Furthermore, the cleaning device 5 for the ink squeezing device 3 and the cleaning device 6 for the anilox roll 1 are not limited to those of the above embodiment but can be of any construction insofar as such a device is adapted to clean the device 3 or the roller 1 while ensuring a color change of ink free of trouble.

[Second Embodiment]

With the printing machine described above, the bank member 32 is turned to its lowered position when the ink squeezing device 3 is cleaned, allowing the waste cleaning liquid in the ink fountain 30 to fall into the receptacle 53 of the cleaning device 5.

However, the present applicant found the following point to be improved. The impact resulting from the turning of the bank member 32 scatters the ink toward the anilox roll 1, soiling the roll 1 with the waste cleaning liquid. Further if the ink squeezing device 3 is moved away from the anilox roll 1 with the waste cleaning liquid remaining in the ink fountain 30 fully to the height of the doctor blade 31, the waste liquid adheres in the form of a line to the anilox roll 1 at the portion thereof which was in contact with the doctor blade 31. This appears attributable to the scatter of the waste liquid due to the vibration involved in the movement of the device 3 away from the roll 1.

The adhering waste liquid flows down the peripheral surface of the anilox roll 1, giving rise to the problem of soiling the corrugated board sheet to be subsequently printed on. The applicant has conceived the arrangement to be described below to overcome this problem.

Figure 8:
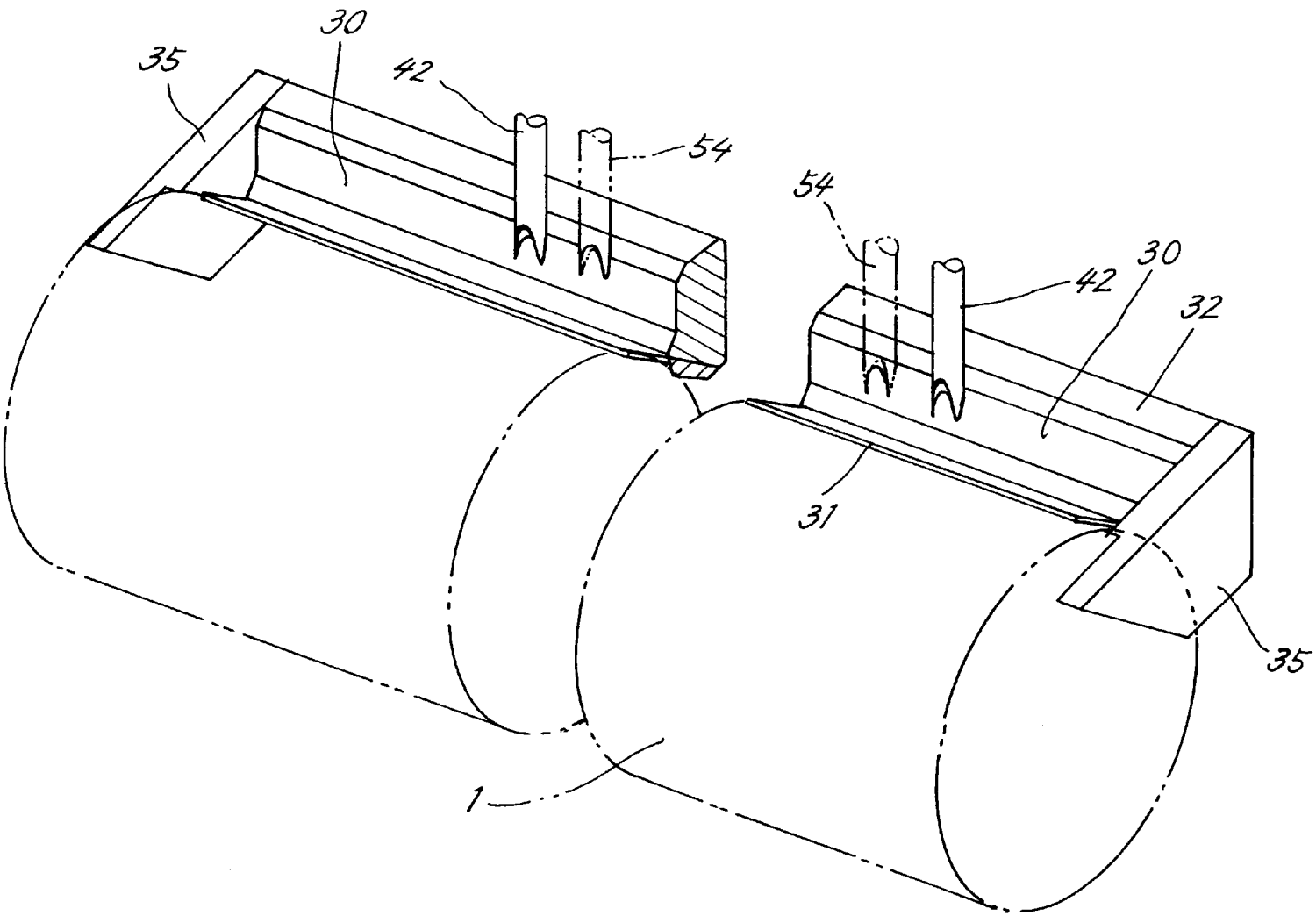
FIG. 8 is a perspective view of an anilox roller and waste cleaning liquid collecting nozzles.
Figure 9:
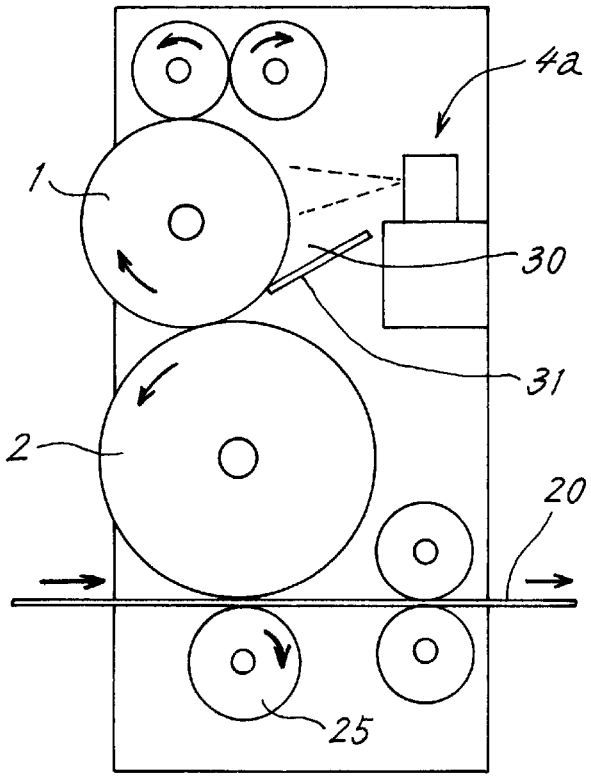
FIG. 9 PRIOR ART
FIG. 9 is a side elevation schematically showing the construction of a Prior Art printing machine previously proposed by the present applicant.
Figure 10:
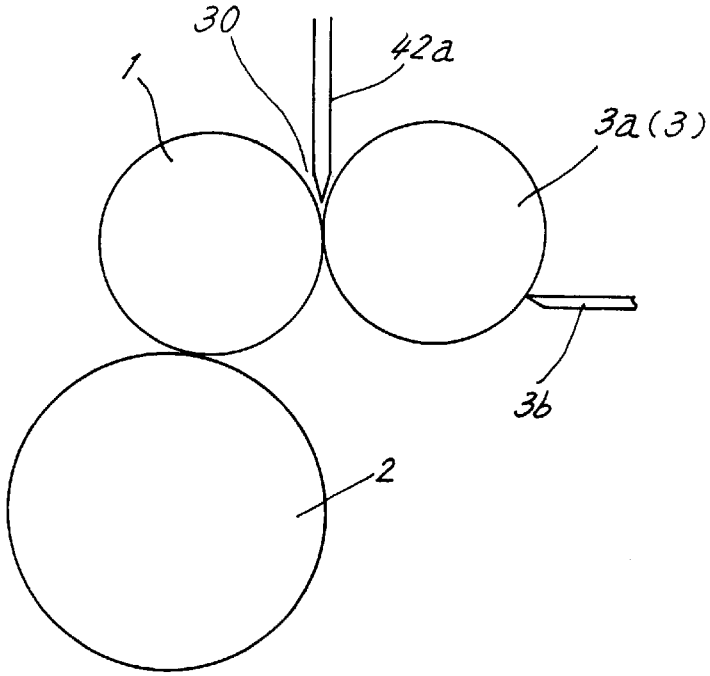
FIG. 10 PRIOR ART
FIG. 10 is a side elevation schematically showing the construction of a Prior Art modification of the printing machine shown in FIG. 9.

FIG. 8 is a perspective view of the anilox roll 1 and the surroundings. Waste liquid collecting nozzles 54, 54 are arranged in the vicinity of the respective ink supplying-collecting nozzles 42, 42 inwardly thereof. The collecting nozzles 54, 54 are movable upward and downward and are also movable laterally along the anilox roll 1 together with the ink supplying-collecting nozzles 42, 42.

The nozzles 54, 54 are connected to a suction device (not shown) which is separate from the vacuum-pressure box 41 for the nozzles 42, 42, and the waste cleaning liquid aspirated by the nozzles 54, 54 remains unmixed with the ink. The correcting nozzles 54, 54 have lower ends positioned inside the ink fountain 30 and so shaped by cutting as to intimately fit to the bottom portion of the ink squeezing device 3 like the ink supplying-collecting nozzles 42, 42. As shown in FIG. 1, the water supply nozzle 51 is disposed above the nozzle 42.

[Cleaning]

The second embodiment is characterized by the operation of cleaning the ink squeezing device 3, and operates in the same manner as the first embodiment with the exception of this feature.

As previously stated, the waste liquid used for cleaning the anilox roll 1 partly flows into the ink fountain 30. When the level of the waste cleaning liquid is detected, for example, by the liquid level detector on the bank member 32, the waste liquid collecting nozzles 54, 54 are lowered. The nozzles 54, 54 aspirate the waste liquid for collection while being slidingly moved laterally in the lowered position, whereby the anilox roll 1 and the ink fountain 30 are completely cleaned within a short period of time.

Since the waste cleaning liquid is collected by the nozzles 54, 54 according to the present embodiment, there is no need to turn the ink squeezing device 3 to the lowered position facing downward for the disposal of the waste liquid. The turning cylinder devices 38, pipe 52 for jetting out the cleaning liquid and receptacle 53 can therefore be dispensed with.

In the case where the ink fountain 30 is accessible by the jet from the cleaning liquid supply nozzle 64 of the anilox roll cleaning device 6, the nozzle 64 is usable also for cleaning the ink squeezing device 3, so that the nozzle for cleaning the device 3 only is not always necessary.

What is claimed is:

1. A printing machine for corrugated board sheets comprising an anilox roll having minute indentations over an entire surface thereof and movable into and out of contact with a printing die mounted on a plate cylinder, an ink squeezing device opposed to the anilox roll and movable into and out of contact therewith, an ink fountain provided between the anilox roll and the ink squeezing device, an ink feeder for supplying ink to the ink fountain, and an ink collector for collecting the ink from the ink fountain by aspiration, the ink squeezing device comprising a doctor blade having an edge for contact with the anilox roll, the doctor blade being in contact with the anilox roll at an angle against the rotation of the roll during printing, the ink squeezing device having a bank member extending axially of the anilox roll and supporting the doctor blade, the ink squeezing device being coupled to a cylinder device for pressing the doctor blade against the anilox roll, the ink fountain being formed by the doctor blade, the anilox roll and a pair of dam members arranged at respective ends of the bank member and lapping over respective end faces of the anilox roll, the cylinder device being operable to press the doctor blade against the anilox roll at least during printing and during cleaning of the anilox roll, the doctor blade being serviceable also to scrape off the ink and a cleaning liquid remaining on the anilox roll during cleaning of the anilox roll, the printing machine being characterized in that:

a nozzle is disposed above the anilox roll for supplying the cleaning liquid, the bank member being pivotally movable between a raised position wherein the doctor blade is in contact with the anilox roll and a lowered position wherein the doctor blade is away from the anilox roll to face downward as shifted from the raised position, permitting the ink fountain to collect therein the cleaning liquid supplied by the nozzle and in the form of a waste liquid as used for cleaning the anilox roll when in the raised position, the bank member permitting the waste cleaning liquid collected in the ink fountain to fall into a cleaning device disposed below the bank member when in the lowered position.

2. A printing machine for corrugated board sheets according to claim 1 wherein the ink squeezing device has surfaces forming the ink fountain and given high water repellency by a surface treatment.

3. A printing machine for corrugated board sheets comprising an anilox roll having minute indentations over an entire surface thereof and movable into and out of contact with a printing die mounted on a plate cylinder, an ink squeezing device opposed to the anilox roll and movable into and out of contact therewith, an ink feeder for supplying ink to an ink fountain provided between the anilox roll and the ink squeezing device, and an ink collector for collecting the ink from the ink fountain by aspiration, the ink squeezing device comprising a doctor blade having an edge for contact with anilox roll, the doctor blade being in contact with the anilox roll at an angle against the rotation of the roll during printing, the ink squeezing device having a bank member extending axially of the anilox roll and supporting the doctor blade, the ink squeezing device being coupled to a cylinder device for pressing the doctor blade against the anilox roll, the ink fountain being formed by the doctor blade, the anilox roll and a pair of dam members arranged at respective ends of the bank member and lapping over respective end faces of the anilox roll, the cylinder device being operable to press the doctor blade against the anilox roll at least during printing and during cleaning of the anilox roll, the doctor blade being serviceable also to scrape off the ink and a cleaning liquid remaining on the anilox roll during cleaning of the anilox roll, the printing machine being characterized in that:

a nozzle is disposed above the anilox roll for supplying the cleaning liquid, the ink feeder being serviceable also as the ink collector and having ink supplying-collecting nozzles and waste liquid collecting nozzles arranged beside the respective nozzles and each having a lower end positioned in the ink fountain for collecting waste cleaning liquid by aspiration.

4. A printing machine for corrugated board sheets according to claim 3 wherein the ink squeezing device has surfaces forming the ink fountain and given high water repellency by a surface treatment.

* * * * *

UNITED STATES PATENT AND TRADEMARK OFFICE

CERTIFICATE OF CORRECTION

PATENT NO. : 6,047,640
DATED : April 11, 2000
INVENTOR(S) : Ichiro Murakawa

It is certified that error appears in the above-identified patent and that said Letters Patent is hereby corrected as shown below:

Column 3,
Line11, "54,54", "(FIG. 8)" should be deleted.
Line 42, "squeazing" should be -- squeezing --.
Line 46, after "view", -- of -- should be inserted.
Line 57, "Prior Art" should be deleted.
Line 60, "Prior Art" should be deleted.

Signed and Sealed this

Ninth Day of July, 2002

*Attest:*

*Attesting Officer*

JAMES E. ROGAN
*Director of the United States Patent and Trademark Office*